United States Patent [19]

Anderson et al.

[11] Patent Number: 4,959,592

[45] Date of Patent: Sep. 25, 1990

[54] STARTING ELECTRODES FOR HID LAMPS

[75] Inventors: John M. Anderson, Scotia; Victor D. Roberts, Burnt Hills, both of N.Y.

[73] Assignee: General Electric Company, Schenectady, N.Y.

[21] Appl. No.: 427,058

[22] Filed: Oct. 26, 1989

Related U.S. Application Data

[63] Continuation of Ser. No. 208,514, Jun. 20, 1988, abandoned.

[51] Int. Cl.[5] ..... H05B 41/24

[52] U.S. Cl. ..... 315/248; 313/161

[58] Field of Search ..... 315/39, 248; 313/153, 313/160, 161

[56] References Cited

U.S. PATENT DOCUMENTS

| | | | |
|---|---|---|---|
| 2,300,916 | 11/1942 | Furedy | 176/124 |
| 2,602,914 | 7/1952 | Schlesman et al. | 321/32 |
| 3,989,983 | 11/1976 | Uchino et al. | 315/248 |
| 4,041,352 | 8/1977 | McNeill et al. | 315/248 |
| 4,176,296 | 11/1979 | Anderson | 315/71 |
| 4,298,828 | 11/1981 | Justice et al. | 315/248 |
| 4,480,213 | 10/1984 | Lapatovich et al. | 315/248 |
| 4,871,946 | 10/1989 | Witting | 315/248 |

FOREIGN PATENT DOCUMENTS

| | | |
|---|---|---|
| 53-4379 | 1/1978 | Japan . |
| 55-161361 | 12/1980 | Japan . |

*Primary Examiner*—David Mis

*Attorney, Agent, or Firm*—Geoffrey H. Krauss; James C. Davis, Jr.; Marvin Snyder

[57] ABSTRACT

An electrodeless high-intensity-discharge lamp, having an envelope situated within the bore of an excitation coil and in the interior of which envelope is to be provided a discharge plasma driven by the excitation coil, is provided with a pair of starting electrodes each of which is either adjacent to, or entering the envelope through, the associated one of an opposed pair of envelope end surfaces. Coupling of a high voltage pulse between the pair of starting electrodes causes an electric field to be produced, between each electrode and the other one of the electrodes or the excitation coil, of magnitude and position sufficient to cause the material within the lamp envelope to create at least one spark channel in which the plasma can then be formed responsive to the normal field provided by the excitation coil.

6 Claims, 1 Drawing Sheet

STARTING ELECTRODES FOR HID LAMPS

This application is a continuation of application Ser. No. 208,514, filed June 20, 198 , abandoned.

BACKGROUND OF THE INVENTION

The present invention relates to electrodeless high-intensity-discharge (HID) lamps and, more particularly, to novel electrodes for initiating a plasma discharge within the arc space of the electrodeless HID lamp.

It is now well known to provide a toroidal light-emitting plasma within the envelope of a HID lamp. The induction arc plasma depends upon a solendoidal, divergence-free electric field for its maintenance; the field is created by the changing magnetic field of an excitation coil, which is typically in the form of a solenoid. It is necessary to develop a very high electric field gradient across the arc tube to start the plasma discharge; it is difficult to develop a sufficiently high electric field gradient, especially in the associated excitation coil, because the coil current may be prohibitively high, even if it is to be provided only on a pulse basis. Further, providing a very high electric field gradient may be impossible because the necessary field-per-turn of the excitation coil may exceed the turn-to-turn electrical breakdown rating of that coil. Thus, it is difficult to provide some means for starting induction-driven HID lamps, and it is also difficult to provide for hot restarting of the same type of lamp. It is therefore highly desirable to provide some means for starting the HID lamp plasma discharge, which starting means can be easily utilized with commercially available lamps, under normal ambient conditions.

BRIEF SUMMARY OF THE INVENTION

In accordance with the invention, an electrodeless high-intensity-discharge lamp, having an envelope situated within the bore of an excitation coil and in the interior of which envelope is to be provided a discharge plasma driven by the excitation coil, is provided with a pair of starting electrodes each of which is either adjacent to, or entering the envelope through, the associated one of an opposed pair of envelope end surfaces. Coupling of a high voltage pulse between the pair of starting electrodes causes an electric field to be produced, between each electrode and the other one of the electrodes or the excitation coil, of magnitude and position sufficient to cause the material within the lamp envelope to create at least one spark channel in which the plasma can then be formed responsive to the normal field provided by the excitation coil.

In presently preferred embodiments, the starting electrodes are conductive members with rounded ends, axially placed along the axis of a substantially cylindrical lamp envelope.

Accordingly, it is an object of the present invention to provide novel starting electrodes for an electrodeless high-intensity-discharge lamp.

This and other objects of the invention will become apparent upon reading the following detailed description, when considered in conjunction with the drawings.

DETAILED DESCRIPTION OF THE INVENTION

Figure 1:
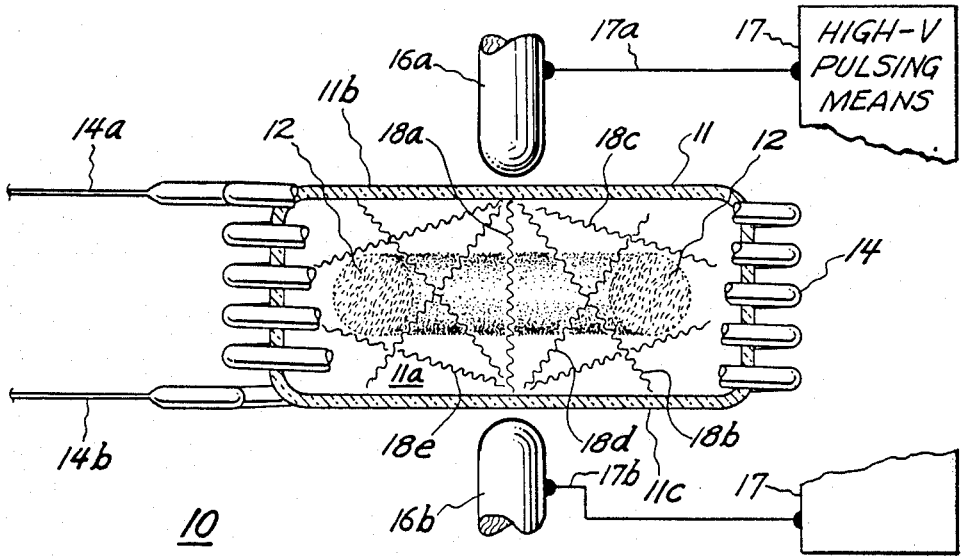
FIG. 1 is a partially-sectioned side view of an electrodeless HID lamp, and of a first embodiment of starting electrodes therefor.

Referring initially to FIG. 1, an induction, or electrodeless, high-intensity-discharge (HID) lamp 10 comprises an arc tube, or envelope, 11 having a substantially cylindrical shape, enclosing a substantially gaseous material **11*a* including a starting gas, such as argon, xenon and the like, and a metal halide, such as sodium iodide and the like. A substantially toroidal plasma arc discharge 12 is maintained within envelope 11 by an electric field generated by an excitation coil 14, responsive to a radio-frequency (RF) signal applied between the opposed coil ends 14*a* and 14*b*. Envelope 11 is positioned with its axis generally along the axis of coil 14**.

In accordance with one aspect of the invention, a pair of starting electrodes **16*a* and 16*b* are provided as elongated conductive members exterior of the top and bottom surfaces 11*b* and 11*c* of the arc tube, and axially extending towards the arc envelope, substantially along the center line thereof. A high-voltage pulsing means 17 applies an alternating voltage to the envelope-exterior electrodes 16, via associated connection means 17*a* and 17*b*, simultaneous with the application of the RF voltage to the excitation coil 14, to cause a starting pre-discharge 18 to be formed within the tube interior 11*a*. This starting pre-discharge forms what may be termed "spark channels" extending from a volume adjacent to one starting electrode rounded end to a volume adjacent to the rounded end of the other starting electrode, such as a first spark channel 18*a*, and also provides the same pre-discharge spark channels within tube 11 randomly from the vicinity from each starting electrode to the entirety of the excitation coil turns; thus, starting channels 18*b* formed from the vicinity of upper starting electrode 16*a* to the lower turns of excitation coil 14, with other starting channels forming to other portions of the excitation coil, until uppermost starting channels 18*c* are formed from the upper starting electrode 16 to the upper turns of the excitation coil. Simultaneously, other starting channels 18*d* are formed from the vicinity of lower starting electrode 16*b* to the upper portions of excitation coil 14, with other channels 18*e* forming from lower starting electrode 16*b* to the lower portions of excitation coil 14, and with yet other channels formed in between channels 18*d* and 18*e*. It will be seen that the majority of spark channels, i.e. those channels 18*b* through 18*e* formed between the starting electrodes and excitation coil 14, provide spark discharges within the arc tube volume which will be substantially filled with the toroidal arc plasma 12, responsive to a high-frequency alternating voltage being applied to electrode 16 from means 17. Thus, if the spark discharges 18 are of sufficient magnitude, some plasma will be formed and will diffuse into the toroidal path of the desired arc, and this diffusing plasma will ignite into the desired toroidal discharge 12. We have found that higher RF frequencies provided by starting power supply 17 lead to broader spark channels 18 and may be helpful in establishing the plasma 12**.

Figure 2:
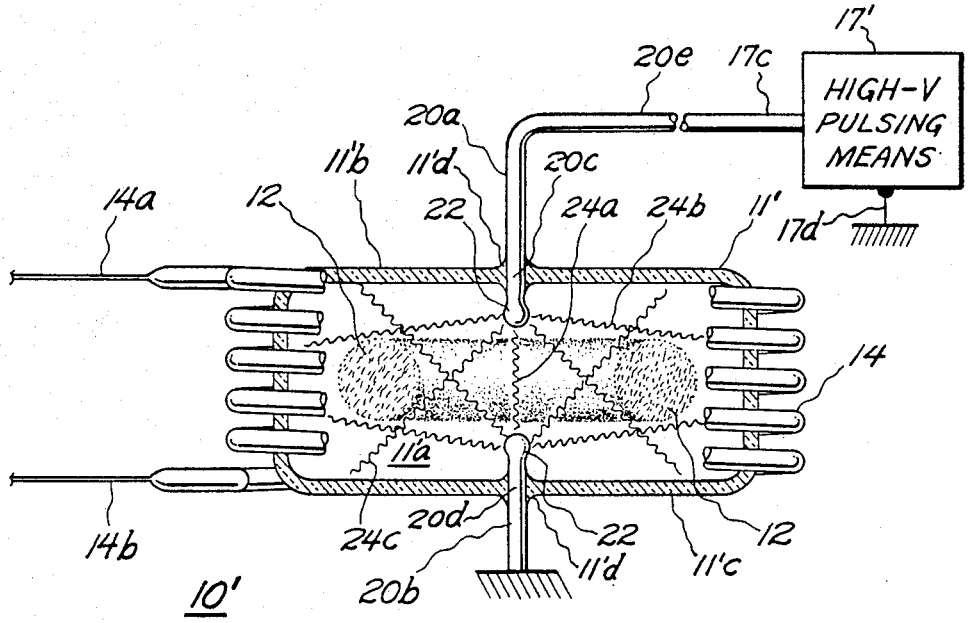
FIG. 2 is another partially-sectioned side view of an electrodeless HID lamp, and of a second embodiment of starting electrodes therefor.

Referring now to FIG. 2, in another presently preferred embodiment, a second lamp 10' has an envelope 11' axially positioned substantially along the axis of excitation coil 14. Arc tube 11' is provided with internal opposed starting electrodes 20. A first, upper starting electrode 20*a* has an end 22, of bulbous and the like configuration, and an electrode portion 20*c* which passes through a portion 11'd of the upper wall 11'b of the arc tube, and is sealed in gas-tight manner therethrough. Similarly, a second, lower starting electrode 20*b* has substantially rounded end 22, and has a portion 20*d* passing through the lower arc tube wall 11'd and sealed in gas-tight manner therethrough. Interior starting electrodes 20 are connected to a suitable high-voltage, high-frequency pulsing means 17', which may have a high-potential output lead 17*c*, with respect to a common circuit potential connection 17*d*; lead 17*c* is connected to the first starting electrode lead portion 20*a*, while the other starting electrode 20*b* is connected to circuit common potential to complete the starting high voltage circuit. Operation of the interior starting electrodes 20 is similar to the operation utilized for starting the arc discharge 12 with the tube-exterior starting electrode 16, although here there is no dependence upon displacement currents passing through the dielectric of the arc envelope top and bottom walls 11*b* and 11*c*, as in the external electrode configuration of FIG. 1, and so the starting current in embodiment 10' can generally be higher. This not only provides a more vigorous spark discharge and better likelihood of main discharge starting, but also, being established within the envelope, rather than by means exterior to the envelope allows the starting electrode separation to be carefully maintained.

Use of starting electrodes 16 or 20 allows a very large starting current (of up to 100, or more, amperes) to be provided for a short period of time by pulsing means 17, simultaneous with the introduction of the RF excitation signal to coil 14. The operation of arc tube 11 then resembles the operation of a flash lamp, wherein a discharge begins as a spark channel, enlarges to a radially-expanding arc column, and moves to the volume where the main arc toroid is finally formed. The plasma radial expansion can be relatively rapid, producing a shock wave which leaves the electron density in its wake of sufficiently high value to start the solenoidal arc. Use of the starting electrodes permits both the cold starting of a high-pressure HID arc, such as one in a lamp using xenon as a buffer gas (at at least 200 Torr pressure), and also permits the hot re-starting of lamps, such as those which use mercury as a buffer gas, immediately after such a lamp has been extinguished. It will be understood that starting electrodes 16 and 20 will generally be made sufficiently thin, in the solenoidal discharge case, so that the starting electrodes will not be excessively heated by the main induction field provided by excitation coil 14. Thus, starting electrodes 20 would penetrate only a short distance into the arcing space, in most cases, and do not interfere with the main arc electrical functions. Starting electrodes are normally made of tungsten, although it should be understood that other metals may be utilized. The starting electrode material should be selected to prevent strong reaction with the arc ingredients, which may be of a chemically-reactive nature (such as chlorine and the like), although it is expected that the starting electrodes will not become hot enough, during normal operation, to adversely react with the arc ingredients. However, the starting electrodes should have sufficient bulk to allow the electrodes to carry starting currents of up to 100 amperes or more expected to be utilized for proper starting of a discharge with a short duration pulse, which may be as short, perhaps, as a few microseconds.

While several presently preferred embodiments of our novel invention have been described in detail herein, it will now be apparent that many modifications and variations can be made by those skilled in the art. It is our desire, therefore, to be limited only by the scope of the appending claims and not by the specific details and instrumentalities presented by way of explanation herein.

What is claimed is:

1. A high-intensity discharge lamp comprising:

a radio-frequency (RF) excitation coil having a bore;

an envelope situated within said RF excitation coil bore, having opposed first and second surfaces and an axis of symmetry, and containing means for sustaining a discharge plasma responsive to the RF magnetic field of said excitation coil; and starting electrode means, adapted to receive a starting signal pulse, for providing at least one spark channel within the envelope to at least assist in the initiation of the discharge plasma when said starting pulse signal is received, and including: a first conductive electrode positioned entirely beyond said first surface, with respect to said envelope, and adjacent to said first surface; and a second conductive electrode positioned entirely beyond said second surface, with respect to said envelope, and adjacent to said second surface; each of the elongated electrodes being aligned substantially along said axis and in a direction opposite to one another and away from envelope.

2. A high-intensity discharge lamp and comprising: a radio-frequency (RF) excitation coil having a bore;

an envelope situated within said RF excitation coil bore, having opposed first and second surfaces, and containing means for sustaining a discharge plasma responsive to the RF magnetic field of said excitation coil; and starting electrode means, adapted to receive a starting signal pulse, for providing at least one spark channel within the envelope to at least assist in the initiation of the discharge plasma when said starting pulse signal is received, and including: a first conductive electrode positioned entirely beyond said first surface, with respect to said envelope, and adjacent to said first surface; and a second conductive electrode positioned entirely beyond said second surface, with respect to said envelope, and adjacent to said second surface, each of the elongated electrodes being elongated in a direction opposite to one another and away from the envelope and having a generally rounded end nearest to said envelope.

3. The lamp of claim 2, wherein the envelope has an axis of symmetry, and the elongated electrode is aligned substantially along said axis.

4. A high-intensity discharge lamp comprising:

a radio-frequency (RF) excitation coil having a bore;

an envelope situated within said RF excitation coil bore, having opposed first and second surfaces and an axis of symmetry, and containing means for sustaining a discharge plasma responsive to the RF magnetic field of said excitation coil; and starting electrode means, adapted to receive a starting signal pulse, for providing at least one spark channel within the envelope to at least assist in the initiation of the discharge plasma when said starting pulse signal is received, and including: an elongated first conductive electrode positioned to extend from beyond said envelope into the interior of the envelope through said first surface; and an elongated second conductive electrode positioned to extend from beyond said envelope into the interior of the envelope through said second surface; each of said elongated electrodes being aligned substantially along said axis and in a direction substantially opposite to one another and away from said envelope; wherein each of the elongated electrodes has a mid-portion passing through the associated surface in a gas-tight manner.

5. The lamp of claim 4, wherein each of the elongated electrodes has a bulbous end within said envelope.

6. The lamp of claim 4, wherein at least the portion of each electrode within the envelope is fabricated of a material substantially unaffected by the discharge sustaining means.

* * * * *